United States Patent [19]

Cash, Sr.

[11] Patent Number: 4,987,762

[45] Date of Patent: Jan. 29, 1991

[54] INDIVIDUALLY VARIABLE MULTI-STATION DRAWING APPARATUS

[75] Inventor: Richard Cash, Sr., Attleboro, Mass.

[73] Assignee: Sterns Metals Inc., R.I.

[21] Appl. No.: 447,842

[22] Filed: Dec. 8, 1989

[51] Int. Cl.[5] ..... B21D 22/28

[52] U.S. Cl. ..... 72/349; 72/361

[58] Field of Search ..... 72/345, 349, 361

[56] References Cited

U.S. PATENT DOCUMENTS

| | | | |
|---|---|---|---|
| 1,935,854 | 11/1933 | McCreary | 72/349 |
| 2,357,683 | 9/1944 | Nelson et al. | 72/361 |
| 2,753,986 | 7/1956 | Morse | 72/349 |
| 3,289,453 | 12/1966 | Wyle et al. | 72/349 |
| 3,525,248 | 8/1970 | Schulte et al. | 72/361 |
| 3,990,289 | 11/1976 | Widmann et al. | 72/345 |

FOREIGN PATENT DOCUMENTS

| | | | |
|---|---|---|---|
| 2743642 | 3/1978 | Fed. Rep. of Germany | 72/349 |

*Primary Examiner*—Lowell A. Larson

*Attorney, Agent, or Firm*—Samuels, Gauthier & Stevens

[57] ABSTRACT

An individually variable multi-stage drawing apparatus has a succession of drawing stations in a multi-level configuration, each station other than the first being vertically offset from and at a level lower than that of a preceding station. Each station includes a circular die through which a workpiece is forced by a cylindrical plunger. Each plunger is operated by its own individual hydraulic ram. In this way, plunger movement commences at a pressure and continues at a rate governed by the metallic flow requirements of the workpiece at each successive drawing stage.

The invention further comprises transfer devices for shifting the workpieces from one drawing stage to the next. These transfer devices grip, carry and release the workpieces without subjecting them to potentially damaging frictional contact.

12 Claims, 5 Drawing Sheets

INDIVIDUALLY VARIABLE MULTI-STATION DRAWING APPARATUS

BACKGROUND OF THE INVENTION

1. Field of the Invention

This invention relates generally to the deep drawing of metal products, and is concerned in particular with an improved apparatus for progressively drawing cup-shaped metal blanks into elongated cylindrical tubes.

2. Description of the Prior Art

With reference to FIG. 1, the present invention is particularly suited for, although not limited in application to, the drawing of tubular barrel and cap sections 10, 12 of writing instruments 14. Such components typically are drawn from a "gold filled" material, which may consist of a base layer of copper composition, with nickel and gold layers superimposed thereon, each layer being bonded to the next adjacent layer.

With reference to FIG. 2, the drawing operation usually begins with a relatively shallow cup-shaped workpiece $W_a$. As the workpiece progresses through a succession of drawing stages, each involving the use of a cylindrical plunger to force the workpiece through a circular die, the workpiece undergoes a gradual lengthening and reduction in diameter as depicted at $W_b$–$W_e$, with the finished piece being shown at $W_f$.

During each drawing stage, the various layers of copper, nickel and gold flow at different rates with respect to each other and in response to different forces acting on the plungers. These variable flow rates and forces change from one drawing stage to the next as the shape of the workpiece changes.

In the past, it has been known to mount the plungers of the successive drawing stages on a common pivotal arm, the latter being operated by a master ram capable of delivering the total force required to effect simultaneous drawing at each stage. The problem with this arrangement, however, is that the plungers move at rates and in response to forces which are fixed in relation to each other, and thus not always suited to the metallic flow requirements at each drawing stage. As a result, drawn products often fail to meet specified tolerances. Where the rate of plunger movement is too rapid, surface cracks may develop in the outer gold layer or in the underlying copper or nickel layers, thus creating flaws which render the workpieces unsuitable for subsequent high tolerance forming operations. In extreme cases, the workpiece may be pierced prematurely at one of the intermediate drawing operations.

A further drawback with the prior art drawing systems stems from the workpieces being subjected to substantial frictional contact with the transfer mechanisms used to shift them from one drawing stage to the next. This often produces surface scratches which disfigure the products and render them unsuitable for their intended uses.

SUMMARY OF THE INVENTION

A general object of the present invention is the provision of an improved multi-stage drawing apparatus which obviates or at least substantially minimizes the above-described short-comings of the prior art.

A more specific object of the present invention is the provision of a multi-stage drawing apparatus wherein plunger movement at each drawing stage is independently variable to accommodate the metal flow characteristics of the workpiece being drawn.

Still another object of the present invention is to provide a drawing apparatus incorporating an improved transfer system which avoids subjecting the workpieces to damaging frictional contact as they are being shifted from one drawing stage to the next.

In a preferred embodiment of the invention to be described hereinafter in greater detail, these and other objects and advantages are achieved by arranging a succession of drawing stations in a multi-level configuration, each station other than the first being vertically offset from and at a level lower than that of a preceding station. Each station includes a circular die through which a workpiece is forced by a cylindrical plunger. Each plunger is operated by its own individual hydraulic ram. In this way, plunger movement commences at a pressure and continues at a rate governed by the metallic flow requirements of the workpiece at each successive drawing stage.

The invention further comprises transfer devices for shifting the workpiece from one drawing stage to the next. These transfer devices grip, carry and release the workpieces without subjecting them to potentially damaging frictional contact.

BRIEF DESCRIPTION OF THE DRAWINGS

A preferred embodiment of the invention will now be described in greater detail with reference to the accompanying drawings, wherein.

DETAILED DESCRIPTION OF PREFERRED EMBODIMENT

Figure 3:
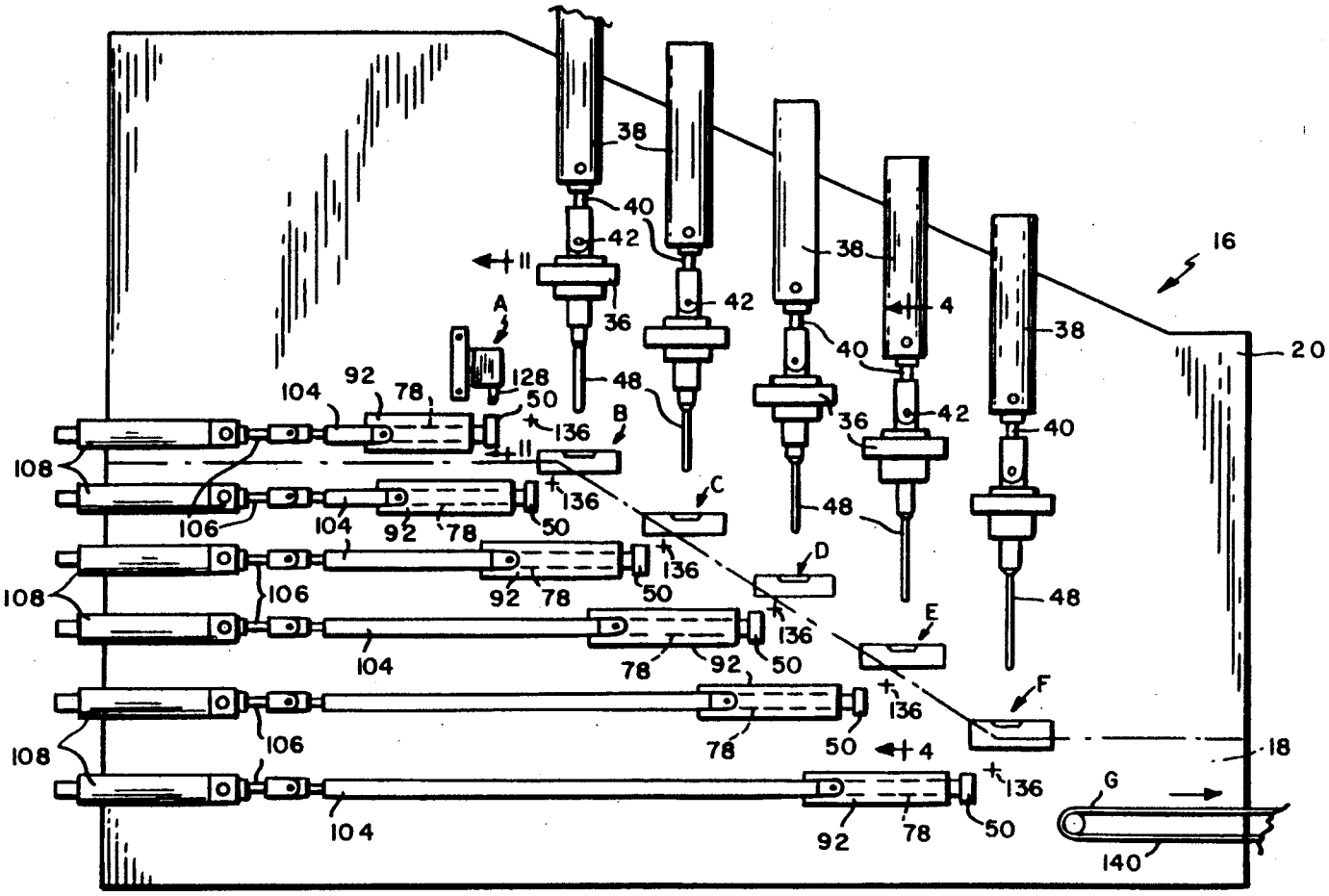
FIG. 3 is a generally schematic view in side elevation of a drawing apparatus in accordance with the present invention.
Figure 5:
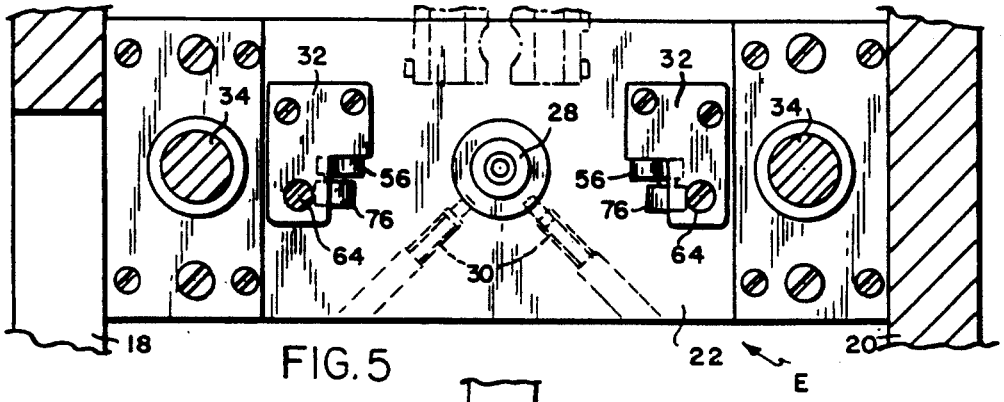
FIG. 5 is a horizontal sectional view taken along line 5—5 of FIG. 4.

With reference initially to FIG. 3, a drawing apparatus in accordance with the present invention is generally depicted at 16. The apparatus includes a receiving station A for receiving the shallow cup-shaped workpieces $W_a$, a succession of drawing stations B–F through which the workpieces $W_a$ are drawn through successive stages $W_b$–$W_f$, and a delivery station G to which the fully drawn workpieces are delivered and accumulated for transfer to subsequent manufacturing or inspection stages.

The components of each station, as well as the transfer mechanisms and other components associated therewith, all to be described hereinafter in more detail, are carried by a support structure which includes massive side plates 18, 20. In FIG. 3, side plate 18 has been shown in phantom so as not to obscure the components arranged internally thereof.

It will be seen that the drawing stations B–F are arranged in a multi-level configuration, with each station other than the first being vertically offset from and at a level lower than that of a preceding station.

Except for die and plunger sizes, the drawing stations are all essentially identical in design and operation. Thus, a description of one will suffice for all. Referring to FIGS. 4–7 which illustrate drawing station E, a horizontal base plate 22 has a central opening 24 communicating with an enlarged diameter circular cavity 26. A die 28 is removably secured in the cavity 26 by means of set screws 30.

Figure 4:
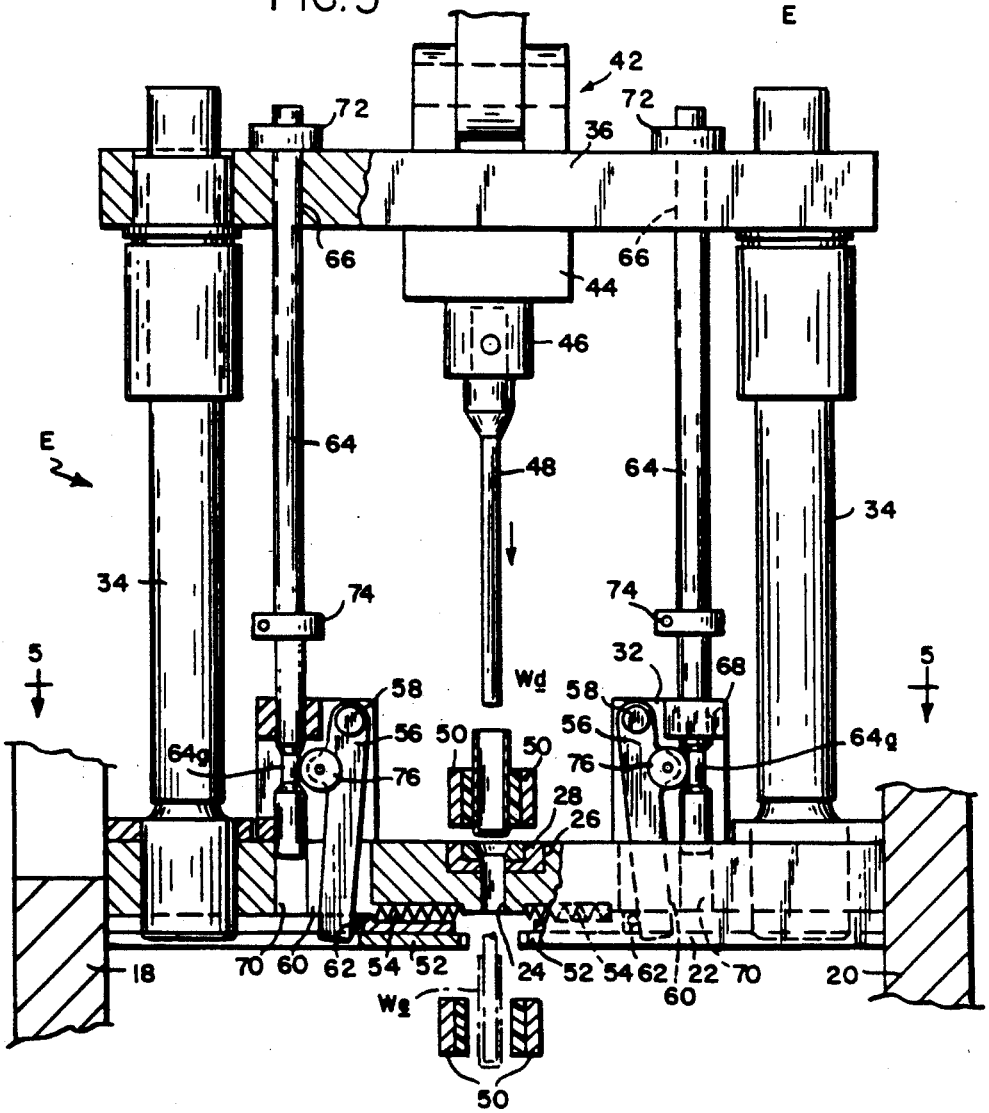
FIG. 4 is a vertical sectional view on an enlarged scale, with portions broken away, taken along line, 4—4 of FIG. 3 and showing a typical drawing station with a workpiece held in a pre-draw position between the die and the retracted plunger.
Figure 6:
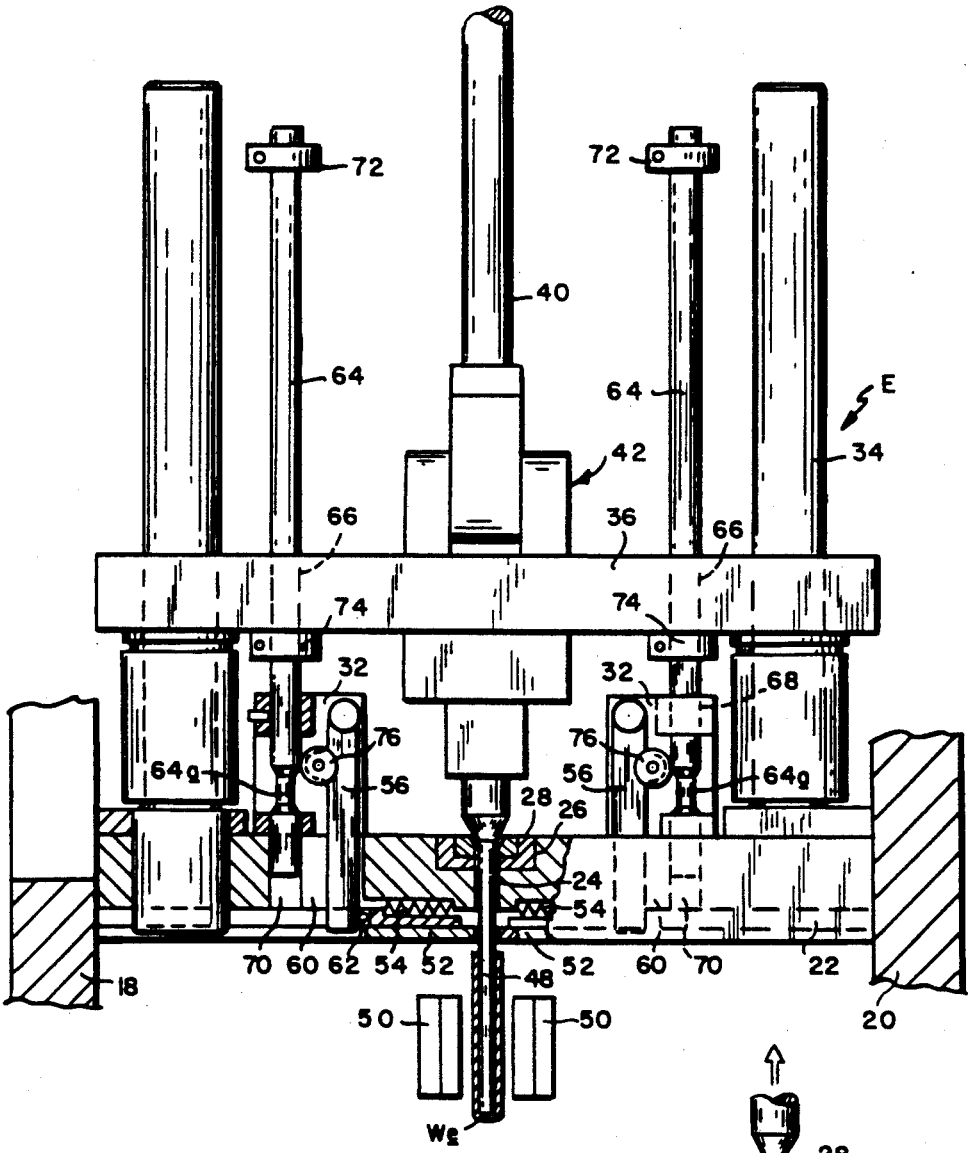
FIG. 6 is a view similar to FIG. 4 showing the workpiece in a drawn position after it has been forced through the die by the plunger.

The base plate 22 carries a pair of fixed pedestals 32, and a pair of upstanding posts 34. A cross beam 36 is slidably carried on the posts 34 for vertical movement between a raised position as shown in FIG. 4, and a lowered position as shown in FIG. 6. The cross beam is reciprocated between its raised and lowered positions by means of a hydraulic ram 38 (see FIG. 3) having its piston rod 40 connected to the cross beam as at 42.

The cross beam 36 is further provided on its underside with a cylindrical boss 44 having a reduced diameter chuck 46 into which is removably secured a cylindrical plunger 48. The plunger 48 and die 28 are appropriately sized to coact with each other in effecting a deep drawing operation on a particular workpiece, which in the case of drawing station E, is the workpiece $W_d$ shown held at a pre-draw location above the die between the closed jaws 50 of a transfer mechanism to be described hereinafter in more detail. Actuation of the ram 38 causes its piston rod 40 to be extended, which in turn effects a lowering of the cross beam 36. This in turn causes the plunger 48 to enter the workpiece $W_d$. Entry of the plunger into the workpiece is accompanied by an opening of the jaws 50 of the transfer mechanism. The plunger 48 and die 28 coact with each other to deep draw the workpiece $W_d$ into the next stage $W_e$ and to locate the same at a drawn position beneath the die as indicated by the broken lines in FIG. 4. The open jaws 50 of another transfer mechanism are positioned to receive the thus drawn workpiece $W_e$ when it is stripped from the plunger 48.

Stripping is effected by a pair of stripper plates 52 slidably mounted in channels on the underside of the base plate 22. In the condition illustrated in FIG. 4, the stripper plates are biased by compression springs 54 to open positions spaced from the path of plunger travel. Actuating levers 56 are carried on the pedestals 32 for pivotal movement about the axes of mounting screws 58. The levers 56 extend through slots 60 in the base plate, and their lower ends are arranged to contact pins 62 carried by the stripper plates 52.

Actuating rods 64 extend through aligned apertures 66, 68 and 70 located respectively in the cross beam 36, the pedestals 32 and the base plate 22. The actuating rods carry mutually adjustable sets of upper and lower collars 72, 74.

When the ram 38 is retracted to elevate the plunger 48 to the uppermost position shown in FIG. 4, the upper collars 72 are contacted by the cross beam 36, causing the actuating rods 64 to be raised to a position at which their reduced diameter segments **64*a* are contacted by rollers 76 carried by the actuating levers 56. As the ram 38 is extended during the drawing operation, the cross beam 36 drops away from the upper collars 72 until it eventually contacts the lower collars 74, thus axially lowering the actuating rods 64. When this occurs, as shown in FIG. 6, the rollers 76 engage the full diameter segments of the rods 64, causing the levers 56 to pivot inwardly towards each other. As the levers pivot inwardly, they overcome the biasing action of springs 54, and urge the stripper plates 52 towards each other to the closed positions shown in FIGS. 6 and 7**.

Figure 7:
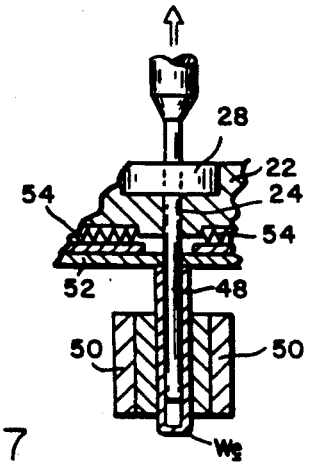
FIG. 7 is a partial view showing the drawn workpiece in the process of being stripped from the plunger.

Once this has occurred and the drawing operation has been completed, the ram 38 is retracted, causing the plunger 48 and the cross beam 36 to move upwardly. The cross beam moves away from the lower collars 74, thus allowing the actuating rods to remain in the positions shown in FIG. 6. The drawn workpiece $W_e$ moves upwardly with the plunger 48 until its upper end contacts the closed stripper plates 52. Then, as illustrated in FIG. 7, as the plunger continues its upward travel, the workpiece $W_e$ remains behind and is gradually stripped off of the plunger. Stripping is accompanied by closure of the adjacent jaws 50 of the transfer mechanism. The actuating rods 64 will remain immobile until their upper collars 72 are contacted by the rising cross beam 36, at which point the actuating rods will be returned to the positions shown in FIG. 4. The rollers 76 will again contact the reduced diameter segments **64*a* of the actuating rods, allowing the levers 56 to pivot outwardly as the stripper plates 52** return to their open positions.

Figure 8:
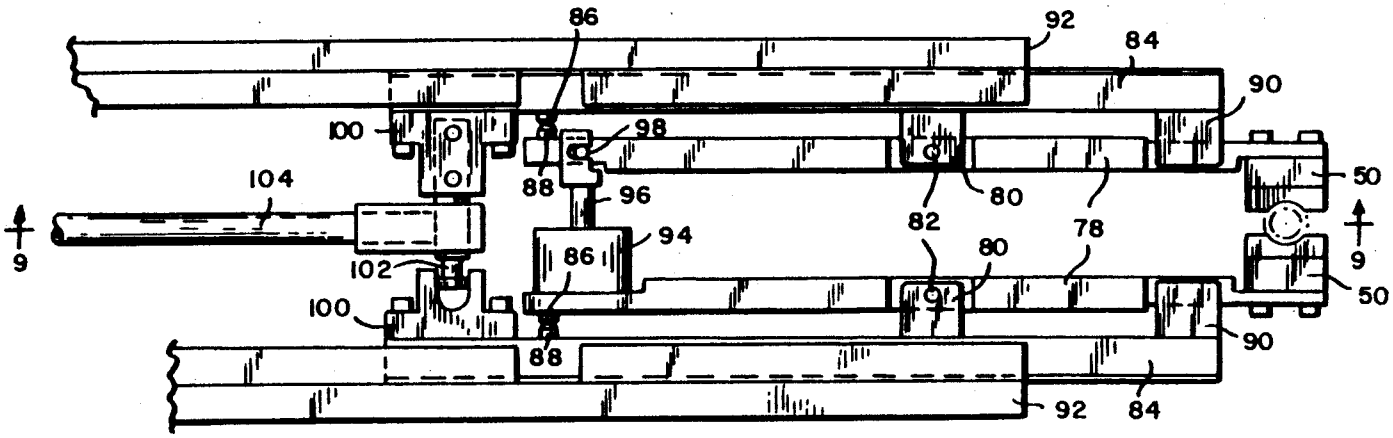
FIG. 8 is a plan view of a typical transfer mechanism.
Figure 9:
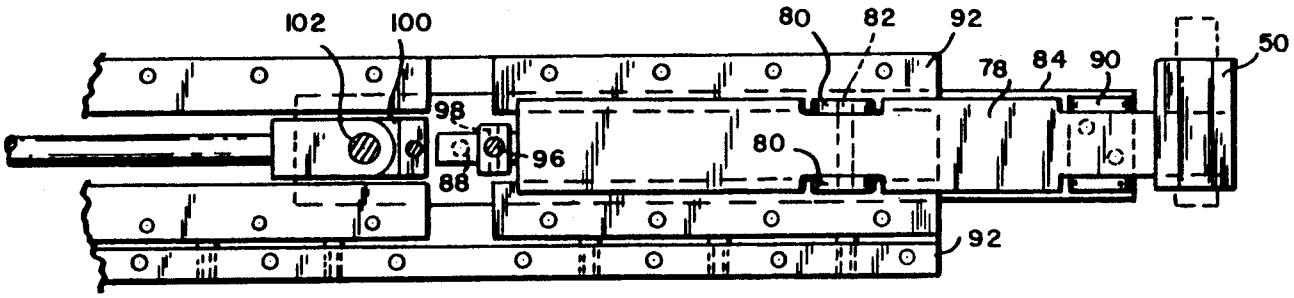
FIG. 9 is a sectional view taken along line 9—9 of FIG. 8.

The workpieces are shifted horizontally from one station to the next by a plurality of individually operable transfer mechanisms. As can best be seen in FIGS. 8–10, each transfer mechanism includes the previously referred to jaws 50 which are carried on the front ends of arms 78. The arms 78 are mounted on middle brackets 80 for pivotal movement about the parallel vertical axes of pins 82. The middle brackets 80 protrude inwardly from slides 84 carrying stop buttons 86 engageable with confronting buttons 88 on the rear ends of the arms 78, and front brackets 90 for guiding and locating the front ends of the arms 78. The slides 84 coact in dovetailed engagement with fixed parallel tracks 92 extending between the respective stations being serviced by the transfer mechanism.

The arms 78 are pivotally manipulated about their pivot pins 82 to open and close the jaws 50 by means of a pneumatically actuated ram 94 having its cylinder fixed to one arm and having its piston rod 96 connected to the other arm as at 98. Extension of the piston rod 96 causes the buttons 88 on the arms to bear against the buttons 86 on the slides 84, thus closing the jaws 50. Suitable means (not shown) may be provided for adjusting the spacing between the buttons 86 in order to accommodate the gripping of different sized workpieces between the jaws 50 without excessive and potentially damaging pressure.

The slides 84 have confronting brackets 100 which receive a cross pin 102 providing a connection to a connecting rod 104. As can be best seen in FIG. 3, the connecting rods 104 of each transfer mechanism are of differing lengths, each providing a connection to the piston rod 106 of a pneumatically actuated ram 108.

Figure 11:
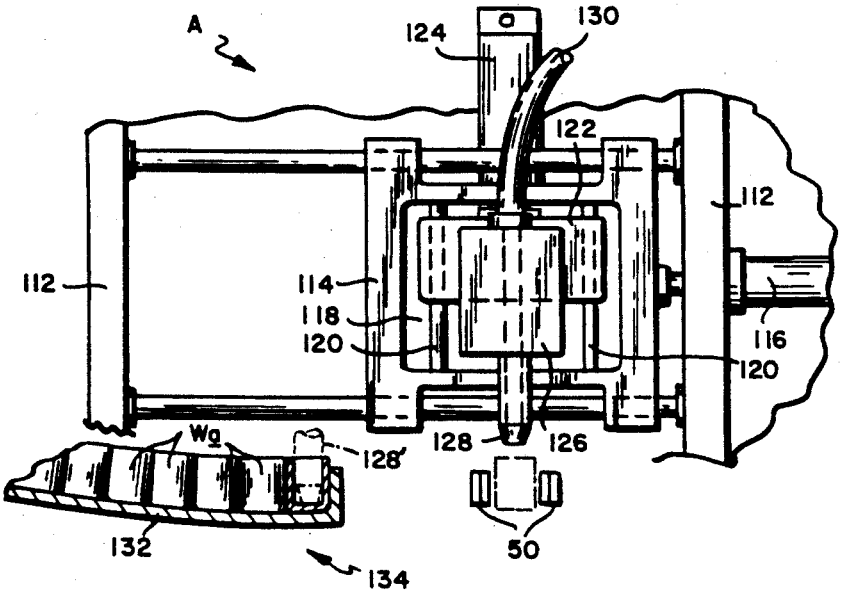
FIG. 11 is a view of the receiving station taken along line 11—11 of FIG. 3.

With reference to FIG. 11, it will be seen that the receiving station A includes parallel horizontal guide rods 110 extending between posts 112. A horizontal slide carriage 114 is mounted on and slidably movable along the rods 110 under the influence of a pneumatically actuated ram 116. The carriage 114 defines a window 118 spanned by vertical guide rods 120. A vertical slide carriage 122 is mounted on and slidably movable along the rods 120 under the influence of a second pneumatically actuated ram 124 carried by the carriage 114. The vertical slide carriage 122 carries a head 126 from which depends a vacuum probe 128 connected to a vacuum source (not shown) by a flexible line 130. A gravity feed chute 132 leads from a supply hopper (not shown) and carries workpieces $W_a$ to a pick-up location 134. Individual workpieces $W_a$ are shifted from the pick-up location 134 to a drop off location between the open jaws 50 of the first transfer mechanism in the following manner: the ram 116 is actuated to shift the horizontal slide carriage 114 to a location at which the probe 128 is aligned axially with the endmost workpiece at the pickup station 134, and the ram 124 is then actuated to lower the vertical slide carriage 122 until the probe is positioned at 128'. Vacuum is then applied to the probe, causing the endmost workpiece to be drawn into contact with the probe. Ram 124 is then actuated to elevate the vertical carriage to remove the probe and workpiece from the chute 132, after which ram 116 is actuated to return the horizontal carriage to the position shown in FIG. 11. The vertical carriage 122 is then lowered to place the workpiece between the jaws 50, after which the jaws are closed, the vacuum interrupted and the carriage 122 elevated. While this is occurring, gravity, assisted if necessary by vibratory action, causes the workpieces $W_a$ to move down the chute 132 until the next workpiece arrives at the pick up location 134.

Figure 10:
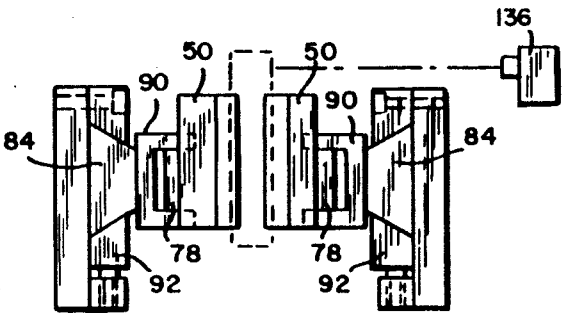
FIG. 10 is an end view of the transfer mechanism.

As can best be seen in FIG. 10, the gripper jaws 50 of each transfer mechanism are configured and dimensioned so as to insure that the upper end portion of a workpiece held therebetween is visible to light emitting sensors 136.

As schematically indicated in FIG. 3, the sensors 136 are strategically positioned at locations along the path of travel of the workpieces through the apparatus. The sensors form part of a computerized control system (not shown) which tracks the progress of workpieces through the apparatus and governs and synchronizes the operation of the various hydraulic and pneumatic rams. Thus, in the event that the delivery chute 132 should be allowed to empty itself, the signals generated by the sensors will allow the computer to track the last workpiece being processed by the apparatus and to gradually shut down each station at the appropriate time. Also, in the event that a workpiece is detected in the jaws of a transfer mechanism delivering it to one station, and after operation of the hydraulic ram to draw the workpiece at that station, no workpiece is detected in the jaws of the transfer mechanism operating to transfer the thus drawn workpiece to the next station, the computer senses that a malfunction has occurred and reacts to immediately shut down the apparatus.

Figure 1:
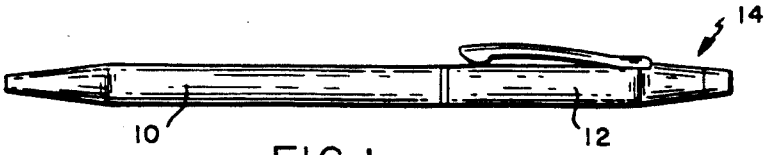
FIG. 1 is an illustration of a typical writing instrument embodying deep-drawn barrel and cap sections of the type produced by the present invention.
Figure 2:
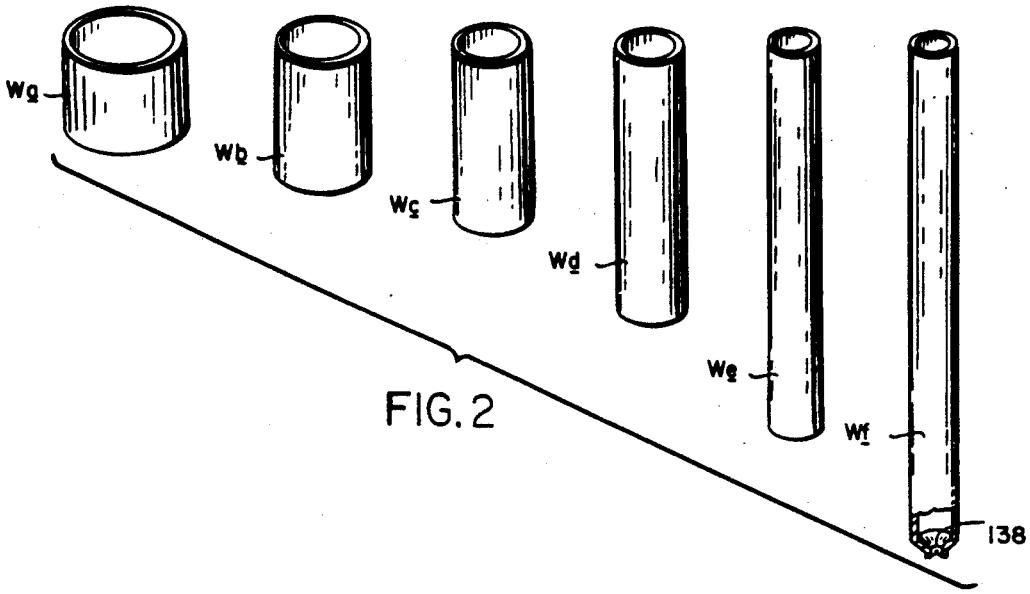
FIG. 2 is an illustration depicting a workpiece at successive stages during the drawing operation.

With reference to FIG. 2, preferably the plunger and die of the last drawing station F are configured and operated to pierce the end of the workpiece $W_f$ as at 138. This facilitates removal of drawing lubricants from the interior of the workpiece prior to completing subsequent shaping operations.

The workpieces $W_f$ are shifted by the last transfer mechanism from station F to a delivery station G, which may for example include a receiving conveyor 140 or the like leading to a receiving hopper (not shown).

In light of the foregoing, it will now be appreciated by those skilled in the art that the present invention offers a number of novel and advantageous features as compared to the prior art. Of prime importance is the provision of individual separately operable rams 38 to control each successive drawing operation. The individual rams react to the metallic flow characteristics of each workpiece and allow each drawing operation to commence at the appropriate pressure and to proceed at the appropriate rate. The transfer mechanisms are designed to grip and release the workpieces without surface scratching or scuffing. The positioning of sensors at strategic locations along the path of workpiece travel allows the progress of workpieces through the apparatus to be closely monitored, thereby providing a means of controlling the successive drawing and transfer operations, and of immediately shutting the apparatus down in the event of a malfunction.

I claim:

1. An individually variable multi-station drawing apparatus for progressively drawing a shallow cup-shaped workpiece into an elongated cylindrical tube, said apparatus comprising:

(a) a succession of drawing stations arranged in a multi-level configuration, each station other than the first of said stations being vertically offset from and at a level lower than that of a preceding station, each station including:

(i) a circular die carried on a base plate having guide posts extending vertically therefrom;

(ii) a cylindrical plunger aligned axially with said die, said plunger depending from a cross beam mounted on said guide posts for vertical reciprocal movement towards and away from said base plate; and (iii) a fluid-actuated ram for vertically reciprocating said cross beam to operate said plunger between a retracted position spaced above said die to accommodate receipt of a workpiece at a pre-draw location interposed between said plunger and said die, and an extended position protruding through said die to force a workpiece from said pre-draw location through said die to a drawn location beneath said die;

the dies and plungers of successive stations being dimensioned to progressively draw said workpiece into said tube;

(b) loading means for positioning successive cup-shaped workpieces at a receiving location in advance of the first of said drawing stations; and (c) transfer means for laterally shifting workpieces from said receiving location to the pre-draw location of the first station, from the drawn location of each station to the pre-draw location of the next successive station, and from the drawn location of the last of said stations to a delivery location.

2. The apparatus of claim 1 further comprising stripper means for stripping drawn workpieces from said plunger.

3. The apparatus of claim 2 wherein said stripper means is operable in response to the vertical movement of said cross beam.

4. The apparatus of claim 2 wherein said stripper means comprises a pair of stripper plates movable in opposite directions between retracted positions remote from said plunger, and operative positions engageable by the drawn workpiece during retraction of said plunger.

5. The apparatus of claim 4 wherein said stripper plates are spring loaded to their retracted positions.

6. The apparatus of claim 5 further comprising actuating means responsive to the movement of said cross beam for shifting said stripper plates from said retracted positions to said operative positions.

7. The apparatus of claim 6 wherein said actuating means comprises levers mounted for pivotal movement on pedestals carried by said base plate, said levers being engageable with said stripper plates, actuating rods extending between said cross beam and said base plate in parallel relationship with said guide posts, said actuating rods having reduced diameter segments engageable by rollers on said levers to accommodate pivotal movement of said levers to positions at which said stripper plates are retracted, and collars on said actuating rods engageable by said cross beam to axially shift said actuating rods to positions at which larger diameter segments thereof engage said rollers and effect pivotal movement of said levers to operatively position said stripper plates.

8. An individually variable multi-station drawing apparatus for progressively drawing a shallow cup-shaped workpiece into an elongated cylindrical tube, said apparatus comprising:

(a) a succession of drawing stations arranged in a multi-level configuration, each station other than the first of said stations being vertically offset from and at a level lower than that of a preceding station, each station including:
   (i) a circular die;
   (ii) a cylindrical plunger aligned axially with and mounted for reciprocal movement in relation to said die; and
   (iii) a fluid-actuated ram for operating said plunger between a retracted position spaced above said die to accommodate receipt of a workpiece at a pre-draw location interposed between said plunger and said die, and an extended position protruding through said die to force a workpiece from said pre-draw location through said die to a drawn location beneath said die;

the dies and plungers of successive stations being dimensioned to progressively draw said workpiece into said tube;

(b) loading means for positioning successive cup-shaped workpieces at a receiving location in advance of the first of said drawing stations; and (c) transfer means for laterally shifting workpieces along a stepped processing path from said receiving location to the pre-draw location of the first station, from the drawn location of each station to the pre-draw location of the next successive station, and from the drawn location of the last of said stations to a delivery location, said transfer means including a plurality of slide assemblies, each slide assembly being shiftable independently of the other slide assemblies along said processing path.

9. The apparatus as claimed in claim 8 wherein each of said slide assemblies carries a pair of pivotal arms, said arms having jaws configured to grip said workpieces, and means carried by said slide assemblies for pivotally manipulating said arms between open positions at which said jaws are spaced one from the other to receive a workpiece therebetween, and closed positions at which a workpiece is gripped between said jaws.

10. The apparatus of claim 9 wherein each slide assembly is connected to and operated by an individual ram.

11. The apparatus of claim 9 wherein said jaws are configured and dimensioned to allow a portion of each workpiece gripped therebetween to be exposed.

12. The apparatus of claim 11 further comprising sensor means for detecting the exposed portions of workpieces gripped between said jaws.

* * * * *